US009434588B1

(12) United States Patent
Dziuk

(10) Patent No.: US 9,434,588 B1
(45) Date of Patent: Sep. 6, 2016

(54) APPARATUS AND METHOD FOR REMOVING BROKEN CORKS

(71) Applicant: Timothy W. Dziuk, Austin, TX (US)

(72) Inventor: Timothy W. Dziuk, Austin, TX (US)

( * ) Notice: Subject to any disclaimer, the term of this patent is extended or adjusted under 35 U.S.C. 154(b) by 269 days.

(21) Appl. No.: 14/263,075

(22) Filed: Apr. 28, 2014

Related U.S. Application Data

(60) Provisional application No. 61/816,276, filed on Apr. 26, 2013.

(51) Int. Cl.
*B67B 7/04* (2006.01)

(52) U.S. Cl.
CPC ..... *B67B 7/04* (2013.01)

(58) Field of Classification Search
CPC ..... B67B 7/04; B67B 7/0447; B67B 7/10; B67B 7/44
USPC ..... 81/3.45
See application file for complete search history.

(56) References Cited

U.S. PATENT DOCUMENTS 4,276,789 A * 7/1981 Allen ..... B67B 7/0447 81/3.36
4,291,597 A * 9/1981 Allen ..... B67B 7/0447 81/3.48
4,429,444 A * 2/1984 Allen ..... B67B 7/0447 140/86
4,574,662 A * 3/1986 Jones ..... B67B 7/063 81/3.45
4,800,784 A * 1/1989 Allen ..... B67B 7/0447 81/3.36
4,916,985 A * 4/1990 Yen ..... B67B 7/063 81/3.45
5,010,790 A * 4/1991 Yen ..... B67B 7/063 81/3.35
5,031,486 A * 7/1991 Rydgren ..... B67B 7/0411 81/3.45
6,324,944 B1 * 12/2001 Presa Eguren ..... B67B 7/04 81/3.45
6,357,322 B1 * 3/2002 Dolan ..... B67B 7/0447 81/3.29
6,820,519 B2 * 11/2004 Lefebvre ..... B67B 7/0429 81/3.45
7,318,362 B1 * 1/2008 Hoyer ..... B67B 7/0447 7/155
2003/0126953 A1 * 7/2003 Kushner ..... B67B 7/04 81/3.45

* cited by examiner

*Primary Examiner* — David B Thomas
(74) *Attorney, Agent, or Firm* — Rick B. Yeager

(57) ABSTRACT

A large diameter corkscrew is inserted into a cork, or into the remaining portion of a broken cork, so that the cork can be extracted through the top of the wine bottle without contacting the wine. In one example, the large diameter corkscrew has a diameter of about 17 mm, as opposed to approximately 8 mm for conventional corkscrews. This larger diameter permits the corkscrew to be inserted into the cork in its unbroken periphery, as opposed to attempting to insert a corkscrew into the debris in the center of a broken cork. In one example, the large diameter corkscrew has a cross section with a flat, angled top portion and a tapered lower portion. This non-circular cross section provides a relatively large contact area for engaging the cork, while providing a reduced cross section area to minimize cork breakage as the corkscrew is inserted into the cork.

10 Claims, 4 Drawing Sheets

APPARATUS AND METHOD FOR REMOVING BROKEN CORKS

RELATED APPLICATIONS

This non-provisional US Patent Application is related to U.S. Provisional Application No. 61/816,276 filed by applicant on Apr. 26, 2013 and claims the benefit of that filing date.

BACKGROUND

1. Field of Invention

The current invention relates to an apparatus and method for removing broken corks from a wine bottle.

BACKGROUND

2. Prior Art

Prior art methods of removing a broken cork typically require that the remaining cork be pushed into the bottle. The cork is then either retrieved with various wire or net devices, or filtered from the wine.

FIG. 1 is a side view of the side portion of a typical prior art corkscrew. In one embodiment, the current invention provides a substantially larger diameter of the spiral portion in order to avoid the crumbled middle portion of a broken cork, so that the spiral portion may be inserted near the side wall of the cork.

FIGS. 2A-2C is a side view of various prior art cork removal devices which comprise a prior art spiral portion as illustrated in FIG. 1. FIG. 2A shows an example "screwpull" device, FIG. 2B shows an example "waiter's friend" device, and FIG. 2C shows an example "butterfly" device.

SUMMARY OF INVENTION

In the current invention, a large diameter corkscrew is inserted into a cork, or into the remaining portion of a broken cork, so that the cork can be extracted through the top of the wine bottle without contacting the wine.

In one example, the large diameter corkscrew has a diameter of about 17 mm, as opposed to approximately 8 mm for conventional corkscrews. This larger diameter permits the corkscrew to be inserted into the cork in its unbroken periphery, as opposed to attempting to insert a corkscrew into the debris in the center of a broken cork.

In one example, the large diameter corkscrew has a cross section with a flat, angled top portion and a tapered lower portion. This non-circular cross section provides a relatively large contact area for engaging the cork, while providing a reduced cross section area to minimize cork breakage as the corkscrew is inserted into the cork.

DESCRIPTION OF EMBODIMENT

Figure 1:
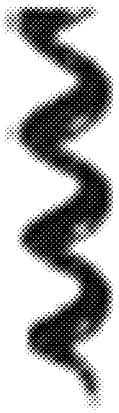
FIG. 1 (PRIOR ART)
FIG. 1 is a side view of the side portion of a typical prior art corkscrew.

The following element numbers referenced in the drawings are provided for convenience.

neck of wine bottle 80
- wall of neck 82 cork 90
- broken cork section 92
- debris 94 conventional spiral corkscrew 70
- tip 72
- diameter 74 large diameter spiral corkscrew 100
- tip 102
- width 104
- Cross Section
- flat top 106
- tapered bottom portion 108

Conventional Corkscrews

Figure 3:
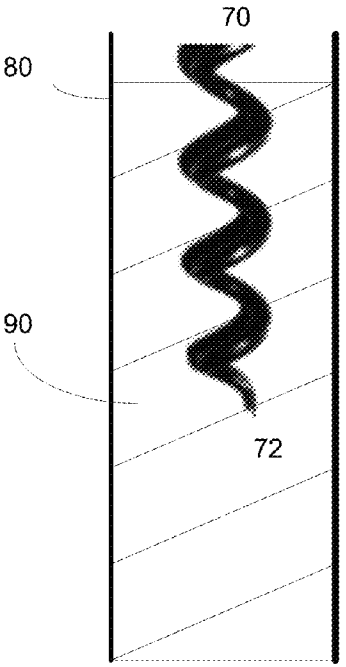
FIG. 3 (Prior Art)
FIG. 3 is a side cross section view of a portion of a conventional prior art spiral corkscrew inserted into a cork which is provided in the neck of a wine bottle.

FIG. 3 is cross section of a typical prior art corkscrew 70 partially inserted into a cork 90 which is secured in the neck 80 of a wine bottle.

Conventional corkscrews, such as screwpull; Waiter's corkscrew; lever models; etc. use approximately the same type of spiral component. These spiral components have typically rounded cross sections and diameters of approximately ½ or less of the cork diameter.

Figure 2A:
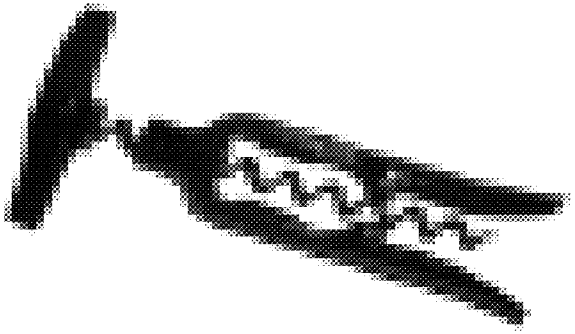
FIG. 2A (PRIOR ART)
FIGS. 2A-2C is a side view of various prior art cork removal devices which comprise a prior art spiral portion as illustrated in FIG. 1.

The screwpull device of FIG. 2A is a popular design which reduces the process of removing the cork into a low effort screw action. A Teflon™ screw thread is introduced into the cork through a guide. By continuing to twist as the head hits the guide, the cork is gently coaxed from the bottle.

Figure 2B:
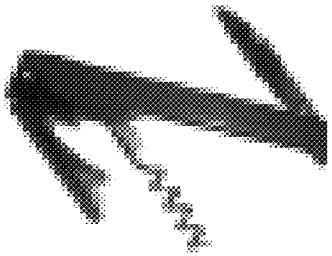
FIG. 2B (PRIOR ART)

The waiter's friend device of FIG. 2B is popular with waiters because it is compact and efficient. After introducing the screw into the cork, the lever is positioned against the rim of the neck of the bottle and a firm action results in the cork being pulled.

Figure 2C:
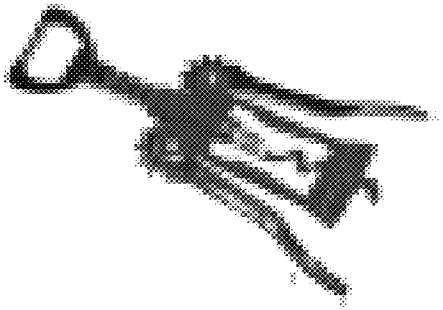
FIG. 2C (PRIOR ART)

In the butterfly device of FIG. 2C, the screw enters the cork as the lever arms are forced upwards. Once in to the hilt, forcing the arms down results in extracting the cork.

Figure 4:
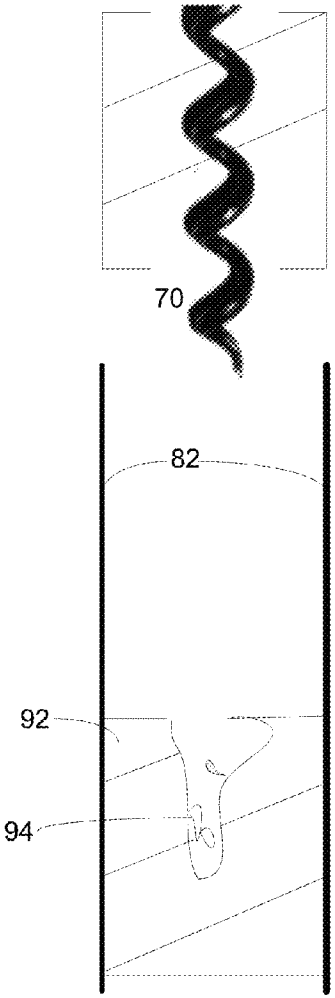
FIG. 4 is a side cross section of a typical broken cork with about half of the cork remaining in the bottle, and debris in the middle of the cork.

When a cork breaks, approximately ½ of the cork remains in the bottle, and the central portion of the cork is crumbled, leaving debris in the remaining cork section. FIG. 4 is a cross section of a typical broken cork with broken cork portion 92 remaining in the bottle, and debris 94 in the middle of the cork.

Extraction of a broken cork is very difficult, and most often the remaining cork is pushed into the bottle, and the wine is filtered when poured.

Figure 6:
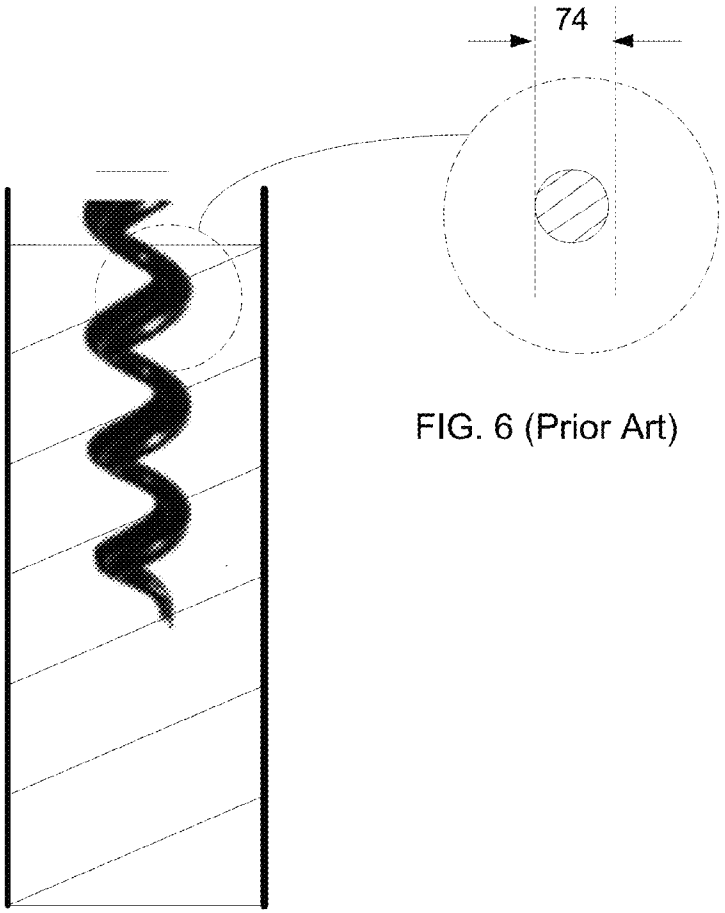
FIG. 6 (Prior Art)
FIG. 6 is a cross section of a prior art circular cross section of a conventional spiral corkscrew.

FIG. 6 is a cross section of a prior art circular cross section of a conventional spiral corkscrew having a circular cross section with diameter 74.

Large Diameter Spiral Corkscrew

Figure 5:
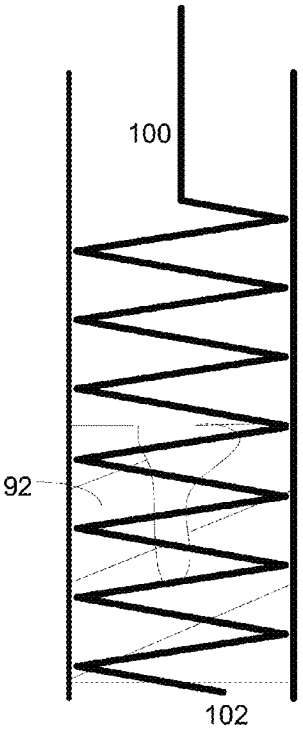
FIG. 5 is a cross section view of an example embodiment of the current invention showing a large diameter corkscrew with a diameter slightly smaller than the inside diameter of the neck of the wine bottle.

FIG. 5 is a cross section view of an example embodiment of the current invention showing an example large diameter spiral corkscrew 100 slightly smaller than the inside diameter of the neck 80 of the wine bottle.

In this example, the cork removal device comprises a corkscrew insertion element, which may be may be a "screwpull" device, a "waiter's friend" device, a "butterfly" device, lever devices, or other device which has a spiral corkscrew element; and a large diameter spiral corkscrew 100.

In one embodiment, the large diameter spiral corkscrew comprises a proximal end portion attached to the corkscrew insertion element, a distal tip 102, and a spiral portion between the proximal end portion and the distal tip, the spiral portion having comprising a plurality of revolutions about a longitudinal axis of the spiral portion, the revolutions having an outer diameter about 1 to 4 mm less than the inside bottle neck diameter.

In one example, the device has a spiral component with a diameter of approximately 17 mm, which is slightly smaller than the diameter of the cork and the inside diameter of the wine bottle neck. The spiral component is designed to fit snugly inside a conventional wine bottle neck 80.

Rather than attempting to re-engage the crumbled central portion of the cork, the device will engage virgin cork at the cork-bottle interface. This approach provides two significant advantages over conventional spiral components. First, it permits the corkscrew to be inserted into the unbroken area of cork between the center and outside edge of the cork. Second, there is a larger cork contact area of the large diameter spiral corkscrew, which facilitates cork removal. In this example, a 14 mm diameter spiral has about 66% greater contact area than a 7 mm spiral of the same cross section and number of turns per unit length.

Cross Section

Conventional corkscrews have a rounded cross section.

Figure 7:
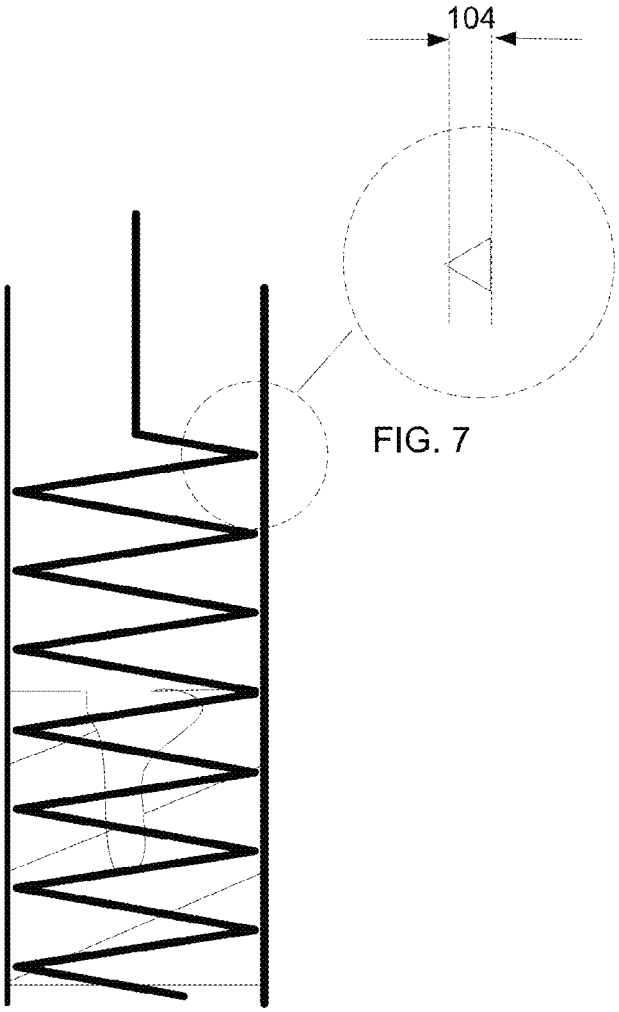
FIG. 7 is a cross section of a triangular cross section of one example of a large diameter spiral corkscrew.

FIG. 7 is a cross section of a triangular cross section of one example of a large diameter spiral corkscrew having a width 104. In this example, the width of the triangular cross section is less than the diameter 74 of a typical prior art corkscrew element.

Figure 8:
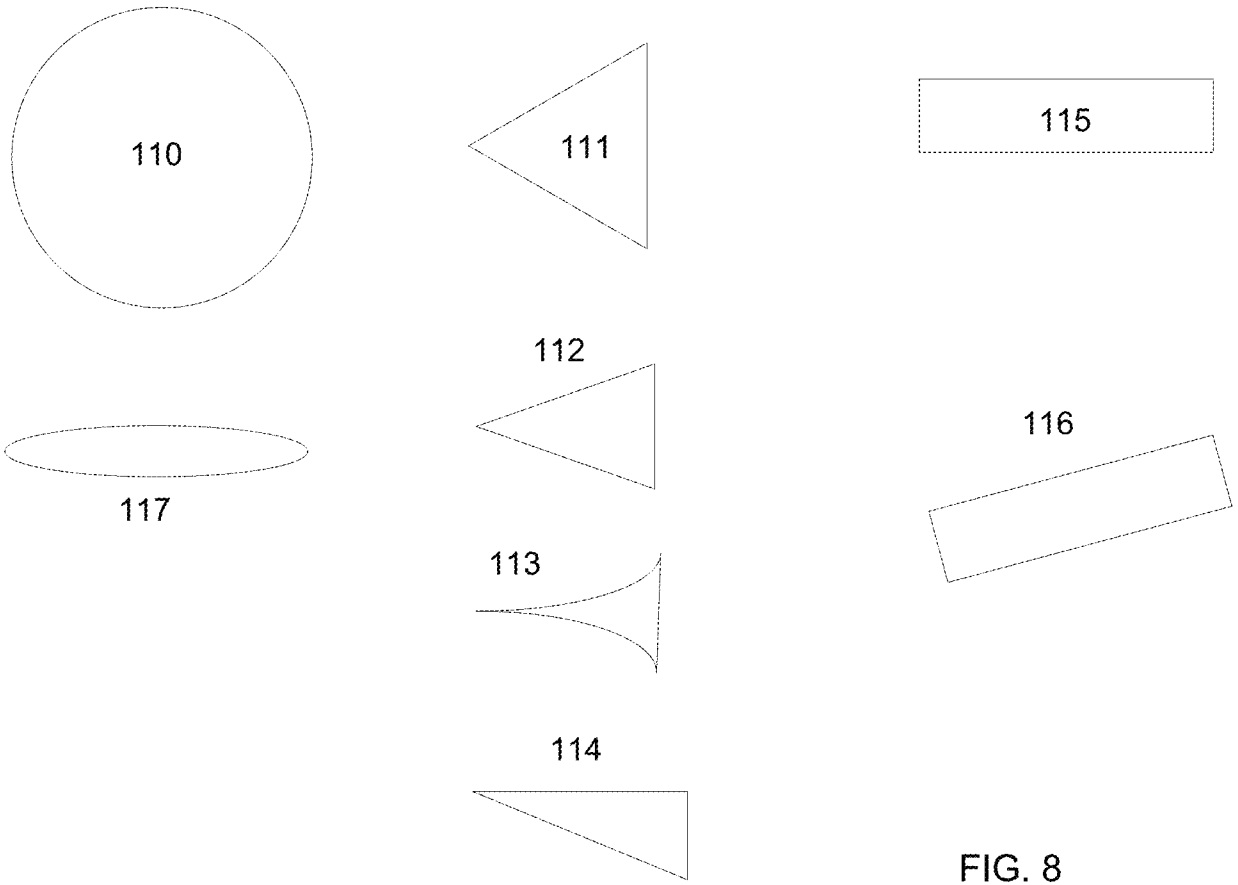
FIG. 8 is an enlarged view of example circular and non-circular cross sections of example large diameter spiral corkscrews.

FIG. 8 is an enlarged view of example circular 110 cross section; and example non-circular cross sections of example large diameter spiral corkscrews including triangular cross sections 111 and 112, elliptical cross section 115, and rectangular cross sections 113 and 114. These profiles permit a relatively large contact area with a relatively small cross sectional area.

It is to be understood that the specific embodiments and examples described above are by way of illustration, and not limitation. Various modifications may be made by one of ordinary skill, and the scope of the invention is as defined in the appended claims.

What is claimed is:

1. A cork removal device for removing cork from a wine bottle, the wine bottle having a neck with an inside neck diameter, the cork removal device comprising a corkscrew insertion element; and a large diameter spiral corkscrew comprising a proximal end portion attached to the corkscrew insertion element, a distal tip, and a spiral portion between the proximal end portion and the distal tip, the spiral portion having a plurality of revolutions about a longitudinal axis of the spiral portion, the revolutions having an outer diameter about 1 to 4 mm less than the inside neck diameter.

2. The cork removal device of claim 1 wherein the corkscrew insertion element is a screwpull device.

3. The cork removal device of claim 1 wherein the corkscrew insertion element is a waiter's friend device.

4. The cork removal device of claim 1 wherein the corkscrew insertion element is a butterfly device.

5. The cork removal device of claim 1 wherein the spiral portion has a non-circular cross section.

6. The cork removal device of claim 5 wherein the spiral portion has a triangular cross section.

7. A method of removing a broken cork from the neck of a wine bottle, the wine bottle having a neck with an inside neck diameter, the method comprising providing a large diameter corkscrew device comprising a corkscrew insertion element, and a large diameter spiral corkscrew comprising a proximal end portion attached to the corkscrew insertion element, a distal tip, and a spiral portion between the proximal end portion and the distal tip, the spiral portion having comprising a plurality of revolutions about a longitudinal axis of the spiral portion, the revolutions having an outer diameter about 1 to 4 mm less than the inside neck diameter;

inserting the spiral portion into the broken cork, such that the spiral portion engages portions of cork in proximity to the neck of the wine bottle; and retracting the spiral portion and cork from the neck of the wine bottle.

8. The method of claim 7 wherein the corkscrew insertion element is selected from the group consisting of a "screwpull" device, a "waiter's friend" device, a "butterfly" device.

9. The method of claim 7 wherein the spiral portion has a non-circular cross section.

10. The method of claim 7 wherein the spiral portion has a triangular cross section.

* * * * *